US008215316B1

(12) United States Patent
Sinclair, Jr.

(10) Patent No.: US 8,215,316 B1
(45) Date of Patent: Jul. 10, 2012

(54) SMOKING ARTICLE AND METHOD

(75) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 456 days.

(21) Appl. No.: 12/463,785

(22) Filed: May 11, 2009

(51) Int. Cl.
*A24D 1/02* (2006.01)

(52) U.S. Cl. ..... 131/281

(58) Field of Classification Search ..... 131/281, 131/58, 250; 206/271
See application file for complete search history.

(56) References Cited

U.S. PATENT DOCUMENTS

| | | | | |
|---|---|---|---|---|
| 6,290,059 | B1 * | 9/2001 | Chuan | 206/238 |
| 7,571,730 | B2 | 8/2009 | Sinclair, Jr. | |
| 2005/0072437 | A1 * | 4/2005 | Gomez | 131/329 |
| 2008/0216847 | A1 * | 9/2008 | Demmer et al. | 131/70 |

* cited by examiner

*Primary Examiner* — Matthew Daniels
*Assistant Examiner* — Cynthia Szewczyk
(74) *Attorney, Agent, or Firm* — Garvey, Smith, Nehrbass & North, L.L.C.; Brett A. North

(57) ABSTRACT

A smoking article provides a purchased, as-built cigar that can be disassembled to form multiple cigars, enabling a consumer to make his or her own cigars using custom tobacco filler. The as-built cigar is capped as part of its construction, preferably at one end or at both ends. A smoker removes the cap or caps to enable smoking of the as-built cigar or disassembly into layers. Each layer can then be rolled with a smoker's custom tobacco. The inner layer contains tobacco filler. Upon disassembly, the inner layer and tobacco filler can be smoked. Alternatively, the inner layer can be pulled apart at a provided serration to discard the tobacco filler and then filled and rolled with a smoker's custom tobacco filler material.

14 Claims, 8 Drawing Sheets

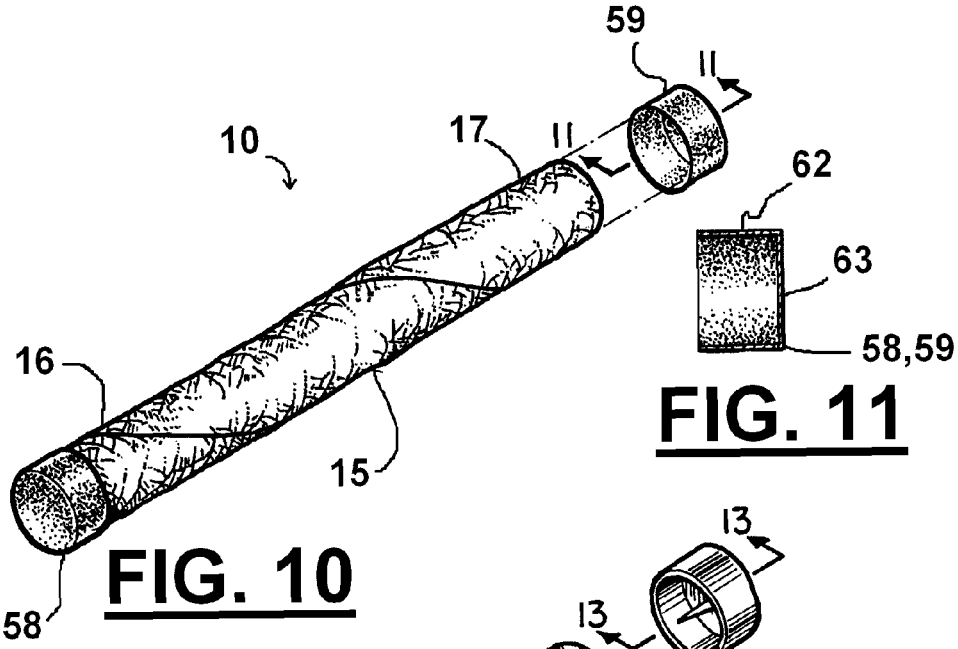
FIG. 10
FIG. 11
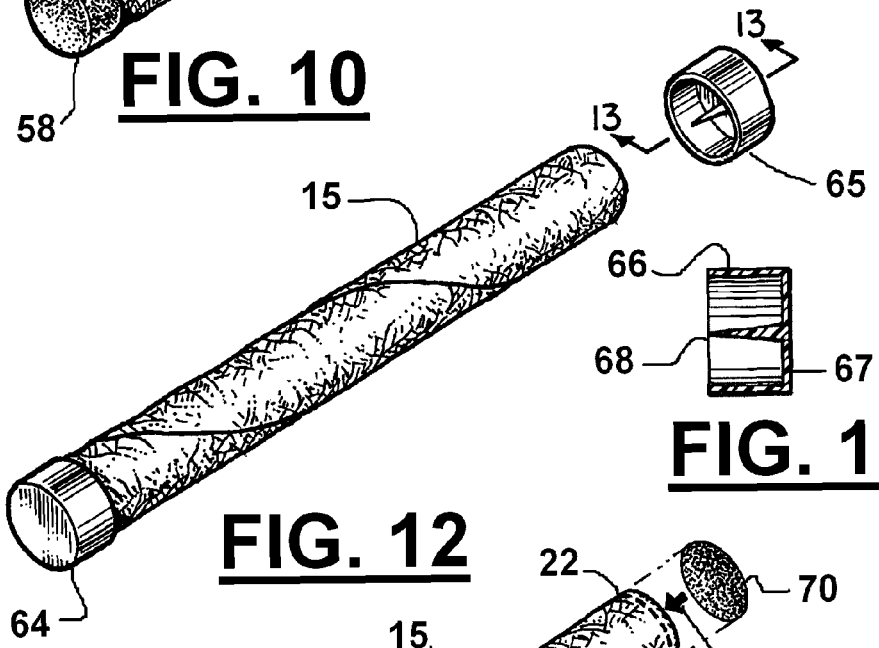
FIG. 12
FIG. 13
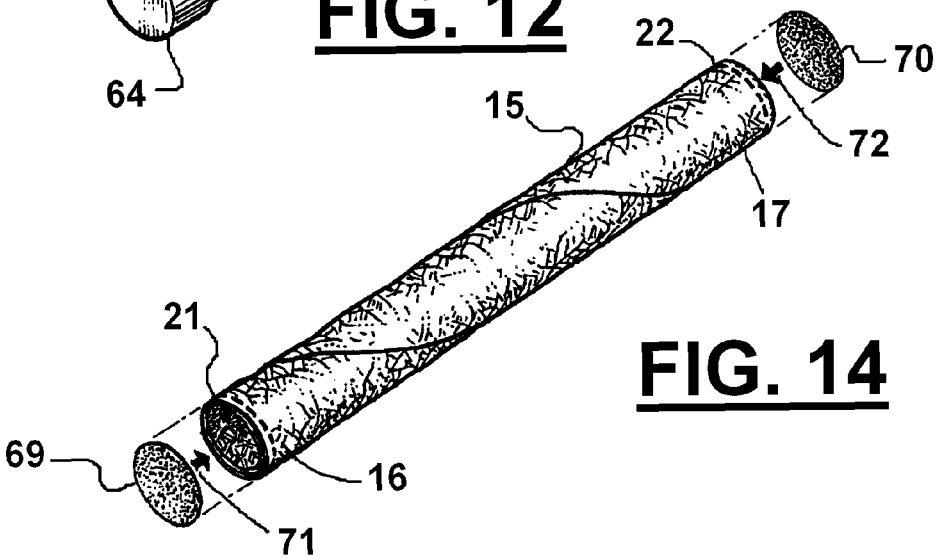
FIG. 14

SMOKING ARTICLE AND METHOD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to tobacco products, namely a cigar that enables a smoker or consumer to fabricate one or more custom cigars by disassembly of an original cigar, allowing the smoker or consumer to choose his or her own tobacco fill material for each custom cigar.

BACKGROUND

In recent years, smoking of cigars has become fashionable and numerous cigar shops have opened around the world to satisfy this growing trend. The variety, quality and size of ready-made cigars satisfy the majority of the public. However, a small segment of connoisseurs insist that nothing can compare with the taste and smell of custom-blended tobacco products. These knowledgeable individuals are very selective in the manner in which their cigars are rolled and in the grade of tobacco used.

A still smaller segment of cigar aficionados prefers to roll their own cigars. They buy tobacco leaves or cigar wrapping and use their preferred brand of crushed tobacco. Some people buy inexpensive cigars, cut them with a sharp blade along the side and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the stuffing of selected tobacco. The edges are then sealed with a liquid or honey, and a new cigar is ready for a smoke.

Some reports indicate that the "roll-your-own" tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of cigars.

SUMMARY

The present invention provides a method of constructing an original or first cigar fabricated of a plurality of sheets or layers of smokable material that include an inner, a middle and an outer sheet or layer. The inner and middle sheets or layers form inner and outer concentric tubes, each tube having tube ends.

As part of the method, at least one of the tubes can be perforated and/or serrated, thus enabling the tube to be opened by rupturing the tube at the perforation and/or serration. The inner tube can be filled with tobacco fill material. An outer sheet or layer can be wrapped around the concentric (middle and inner) tubes. The assembly of tubes is then capped with a cap or caps that prevent discharge of the tobacco fill material from one or both tube ends.

In various embodiments the perforated and/or serrated area can be a cut line, cut area, etched area, stitched area, area of reduced wall thickness. In various embodiments the area can be a line.

A manually rupturable connection is provided between at least one end cap and the assembly of the multiple sheets or layers and tobacco fill material.

In one embodiment, the assembly is capped at each end with a cap.

In one embodiment, at least one of the caps is of a combustible, smokable material.

In one embodiment, both of the end caps are of a combustible, smokable material.

In one embodiment, the rupturable connection includes a perforation or serration of a layer next to the end cap.

In one embodiment, the outer sheet or layer includes a perforation and/or serration next to an end cap.

In one embodiment, rupturable connections in the form of perforations and/or serrations of the outer layer are provided next to each end cap.

In one embodiment, one of the caps is not of a smokable material.

In one embodiment, at least one of the end caps is in the form of twisted tobacco material that is part of the outer layer.

In one embodiment, one or both of the end caps is a disk.

In one embodiment, the original or first cigar can be disassembled to separate the outer sheet or layer while the inner sheet or layer, middle sheet or layer and tobacco filler to define a second cigar. The method can include re-packaging the newly formed second cigar in a package that originally contained the first cigar.

The method can include removing the first cigar from a package and forming one or more new cigars by disassembling the first cigar and forming one of more new cigars using one or more sheets or layers for each new cigar and a user's custom tobacco as a filler material.

In one embodiment, the method comprises removing the original or first cigar from the package and forming multiple new cigars by disassembling the original or first cigar and forming multiple new cigars using one of the multiple sheets or layers for each new cigar and a user's custom tobacco filler material.

In one embodiment, three new cigars can be formed.

In one embodiment, four new cigars can be formed.

One embodiment provides various configurations of pre-rolled sheets on a cigar or cigarillo core. One embodiment includes a layered configuration of pre-rolled sheets including a first sheet of homogenized tobacco paper, a second sheet of natural leaf, and an inner core comprising a cigar or cigarillo. One embodiment includes a layered configuration of pre-rolled sheets including a first sheet of natural leaf, a second sheet of homogenized tobacco paper, and a an inner core comprising a cigar or cigarillo.

One embodiment, over an inner core comprising a cigar or cigarillo, includes a plurality of pre-rolled sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc. In one embodiment access to the inner sheets or layers is provided by removal of end caps.

One embodiment includes sheets made of the same material, such as homogenized tobacco paper, natural leaf, rolling paper, and/or sheets of other smokable materials. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

In one embodiment multiple types of filler material is included which offers the consumer the option of using different types of filler and/or blending between the types of filler included. In one embodiment different types of filler material can be chosen from any combination of the following types of filler material: pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba LennaYesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

One embodiment includes a cigar tip which can be used with the finished tobacco products.

The method of the present invention thus enables an end user to make his or her own custom finished tobacco products with a selected, custom filler material/blend of filler material. The method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

In one embodiment "pig-tailed" type ends can be formed by twisting overlapping sheets in a rope-like formation and then twisting this rope-like formation in a "pig-tailed" type shape. In one embodiment the overlapping sheet can be longer (i.e., overlapping) in a longitudinal direction in one or both ends of a tobacco product.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 10 is a perspective view on alternative tobacco product which includes end cap sleeves (which are smokable) removal of which allow access to the inner multiple sheets or layers of other embodiments providing the user various choices in making one or more custom made cigars.

FIG. 11 is a sectional view taken along lines 11-11 of FIG. 10;

FIG. 12 is a perspective view on alternative tobacco product which includes end cap sleeves (which are not smokable) removal of which allow access to the inner multiple sheets or layers of other embodiments providing the user various choices in making one or more custom made cigars.

FIG. 13 is a sectional view taken along lines 13-13 of FIG. 12; and

FIG. 14 is a perspective view on alternative tobacco product which includes end cap plugs (which are smokable) removal of which allow access to the inner multiple sheets or layers of other embodiments providing the user various choices in making one or more custom made cigars and also showing circumferential perforations or serration facilitating removal of one or both end plugs.

DETAILED DESCRIPTION

Figure 1:
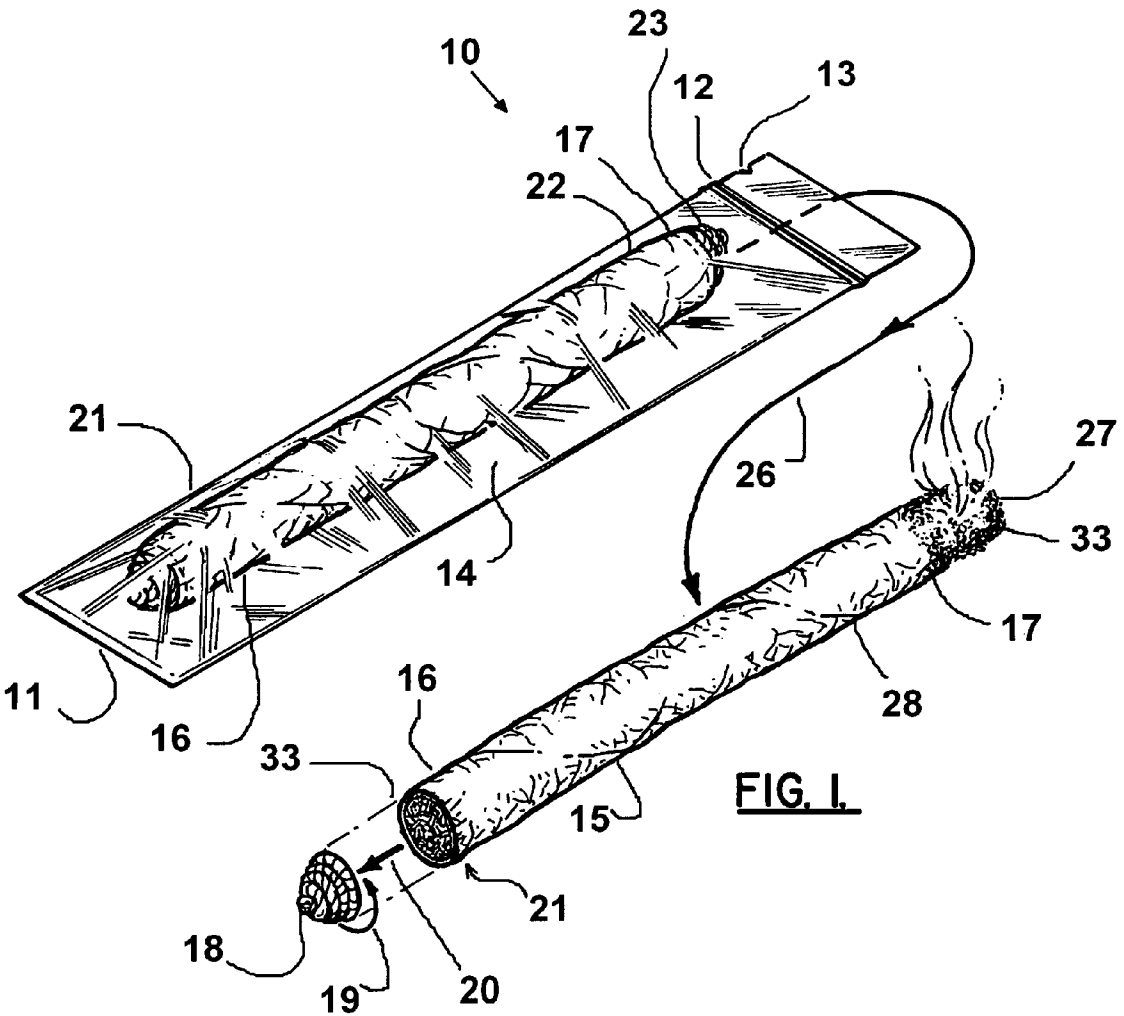
FIG. 1 is a perspective view of one preferred embodiment showing a tobocco product which can be a multi-sheet/multi-layered finished cigar which is packaged for sale where such tobacco product has two ends comprising enclosed "pig-tailed" type rolled areas along with circumferential perforations allowing easy removal of such "pig-tailed" ends, and also showing the tobacco product removed from the packaging where one of the "pig tail" type ends are removed by a twisting, pulling, and/or rotating action, along with the other end being lit for smoking (either with or without removal of the other pig tail type end)

FIGS. 1-8 show the preferred embodiment of the apparatus of the present invention designated generally by the numeral 10. FIGS. 1-8 also show the method of the present invention which provides a method of constructing one or more cigars from an existing as bought cigar. In FIG. 1, the cigar article 10 of the present invention provides a first cigar 15 which is a commercially available or as-built and packaged cigar 15 as purchased by a consumer or customer. First cigar 15 thus is contained in package 11 which can be a plastic, heat sealed or other package. Package 11 can provide a resealable closure 12 and a tear notch 13 for enabling access to the resealable closure 12. The resealable closure 12 can be sealed as manufactured to prevent contamination from moisture. Package 11 can thus have an interior 14 that is of a controlled environment upon manufacture. By tearing package 11 at tear notch 13, package 11 can be opened.

Figures 2, 3:
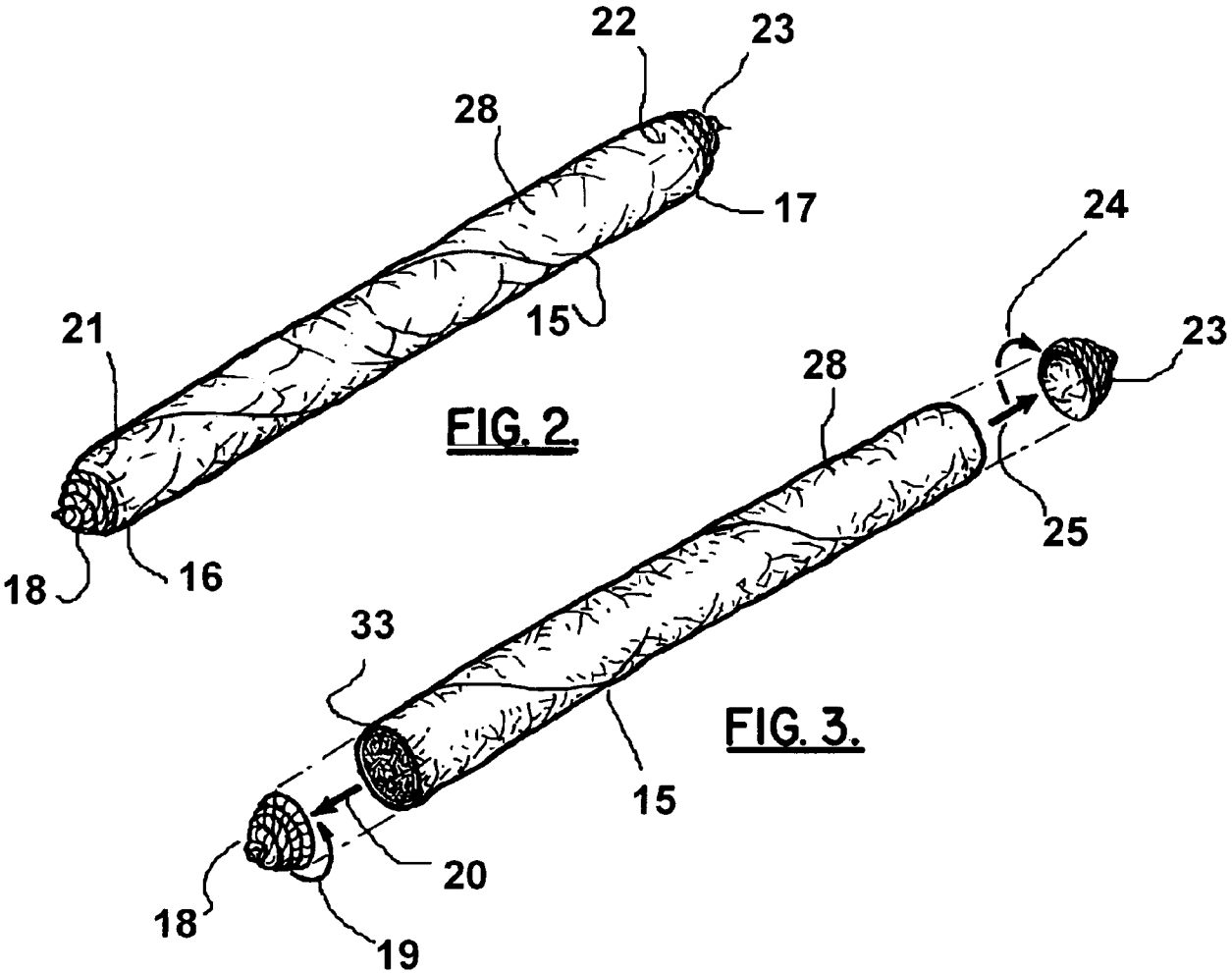
FIG. 2 is another perspective view showing the tobacco product of FIG. 1 removed from the packaging.
FIG. 3 is a perspective view of the tobacco product of FIG. 2 with both ends having been removed by twisting, pulling, and/or rotating providing access to the various sheets or layers for a user.

First cigar 15 provides end portions 16, 17. Each of the end portions 16, 17 is closed with an end cap 18 or 23. In FIG. 1, each end cap 18 or 23 can be removed by twisting as illustrated by arrow 19. In FIG. 1, one of the end caps 23 has been removed at end portion 17. The other end portion 16 illustrates removal of end cap 18 by twisting in the direction of arrow 19 in order to tear provided serrations 21 or 22. Serrations 21 are provided at end portion 16. Serrations 22 are provided at end portion 17 as shown in FIGS. 1, 2 and 3. In FIG. 1, end cap 23 has been removed at end portion 17. The other end cap 18 is shown being removed from end portion 16. In this fashion, a user can light end portion 17 to produce a burning part 27. A user or consumer can smoke the entire as-built first cigar 15 after removal from package 11 as illustrated by arrow 26.

Figure 4:
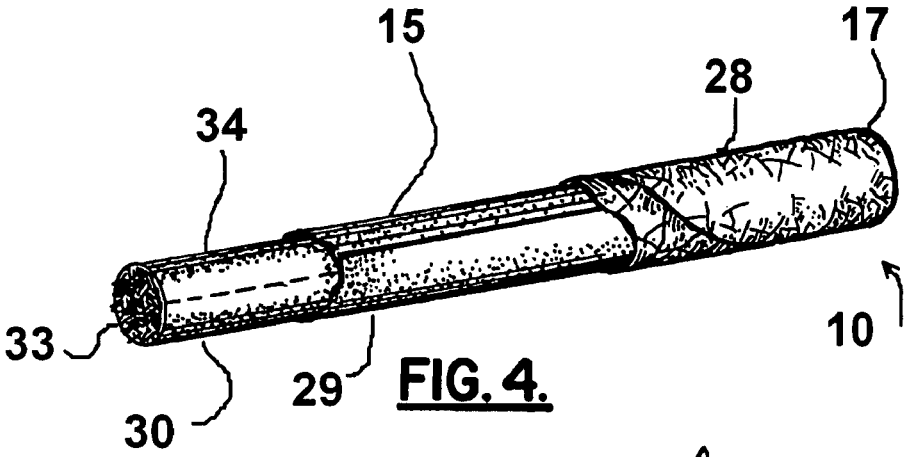
FIG. 4 is a partially cutaway perspective view of the tobacco product shown in FIG. 3 showing each of the sheets or layers including the outer sheet of natural leaf, middle sheet or homogenized tobacco paper, and inner cigar or cigarillo core where the core has a longitudinal set of perforations on its wall.
Figure 5:
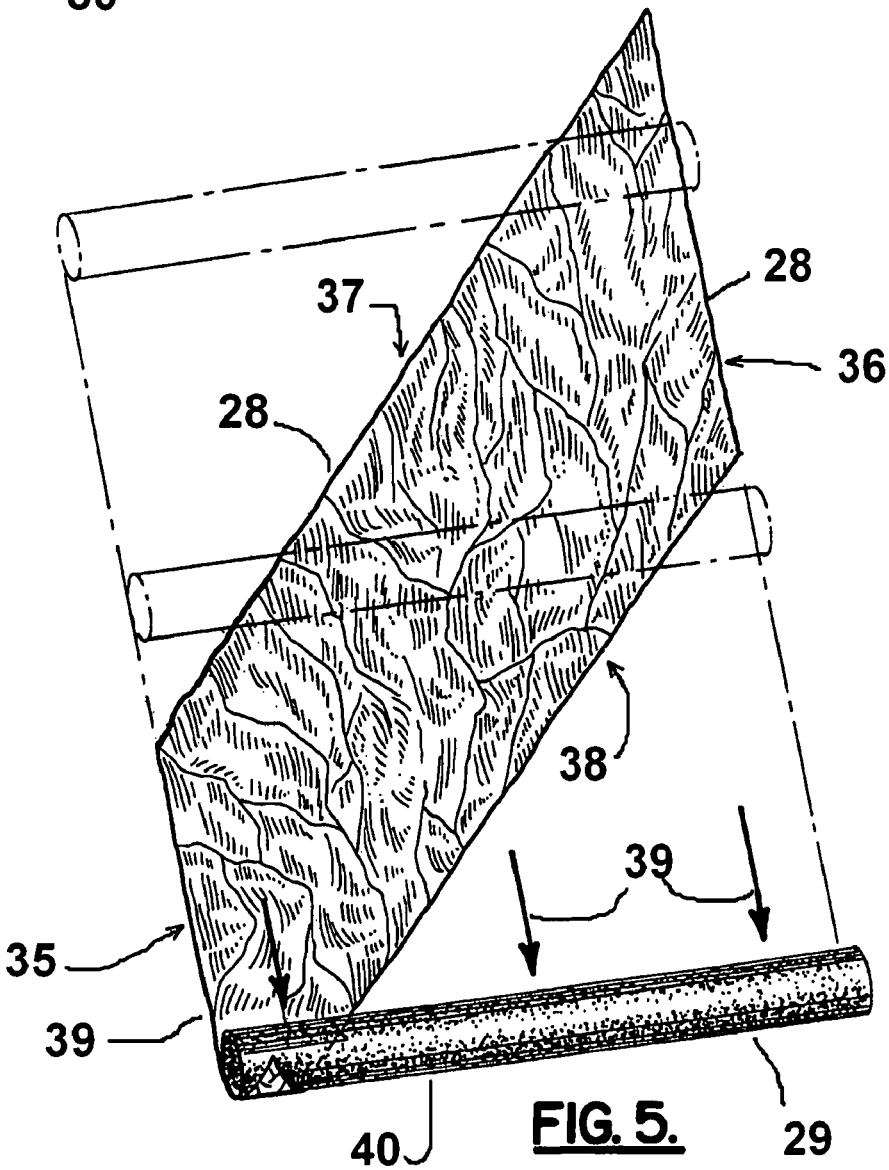
FIG. 5 is a perspective view of the tobacco product shown in FIG. 3 where the outer sheet or layer is removed from the tobacco product leaving the middle sheet or layer and the inner cigar or cigarillo core remaining with the tobacco product.

FIGS. 2-6 illustrate that first cigar 15 can be disassembled to produce a second cigar 40, a third cigar 43, a fourth cigar 47 and if desired a fifth 48 and sixth 50 cigar. FIGS. 2-6 illustrate the disassembly of first cigar 15 to produce second cigar 40 and third cigar 43. In FIG. 2, first cigar 15 is shown with its end caps 18, 23. In FIG. 3, the end caps 18, 23 are removed. Removal is illustrated by a twisting action, rotating cap 18 as illustrated by arrow 19 which breaks or ruptures perforations or serrations 21. After twisting the end cap 18 and breaking or rupturing the perforations or serrations 21, cap 18 is separated from first cigar 15 as illustrated by arrow 20. Similarly, arrow 24 illustrates a rotation of end cap 23 to break perforation or serration 22, thus enabling a separation of cap 23 from first cigar 15 as illustrated by arrow 25. After removal of the end caps 18, 23, FIGS. 4 and 5 illustrate that first cigar 15 is manufactured of three sheets or layers 28, 29, 30. These layers include an outer sheet or layer 28, an inner sheet or layer 30, and intermediate or middle sheet or layer 29. FIG. 5 illustrates that after removing end caps 18, 23, the outer sheet or layer 28 can be unrolled as illustrated by arrows 39. This separates the outer sheet or layer 28 from the remaining two sheets or layers 29, 30 and from a tobacco filler 33 contained within sheet or layer 30.

The outer sheet or layer 28 can have edges 35, 36 which can be parallel to one another and edges 37, 38 which can be parallel. The edge 37 can form an acute angle with edge 36. The edge 35 can form an acute angle with the edge 38 as shown in FIG. 5. Edges 37, 38 are thus diagonally extending edges.

Figure 6:
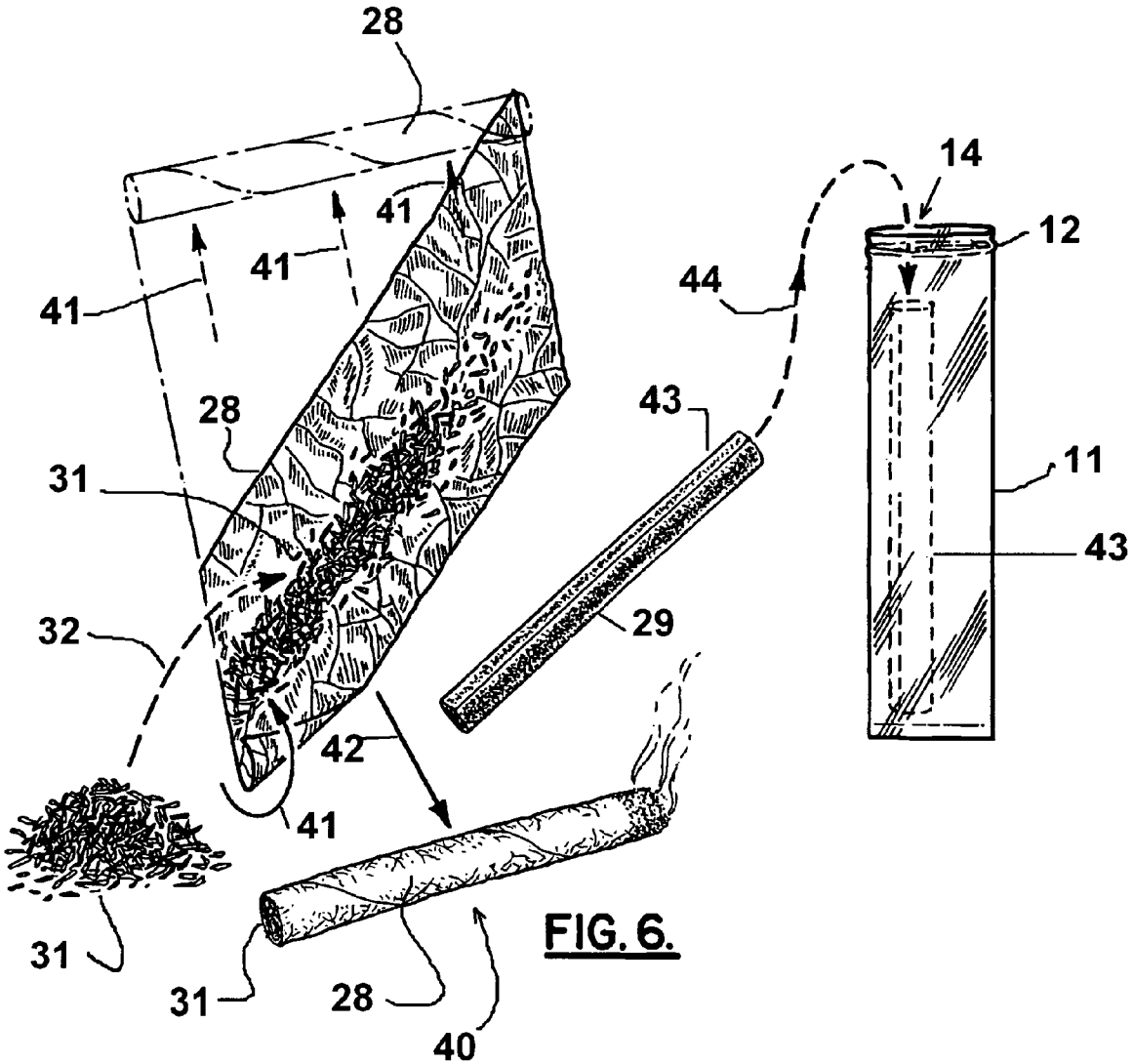
FIG. 6 is a perspective view illustrating various method steps where the outer sheet or layer is removed from the tobacco product and used to make a custom cigar and lit for smoking, along with returning the remaining middle sheet or layer and inner cigar or cigarillo core into the original packaging.

After separating sheet or layer 28 from the other sheets or layers 29, 30 and filler 33, a second cigar 40 can be formed by rolling the outer sheet or layer 28 about a user's custom tobacco 31 as shown in FIG. 6. Arrow 32 in FIG. 6 illustrates the placement of a user's custom tobacco 31 on layer 28. Arrow 41 illustrates a rolling of sheet or layer 28 about the user's custom tobacco 31 to form second cigar 40 as shown in FIG. 6. Second cigar 40 can then be smoked wherein the second cigar 40 comprises a user's custom tobacco 31 and the outer sheet or layer 28 that was removed from first cigar 15.

After removing sheet or layer 28, the remnants of the first cigar 15 are shown in FIG. 6, designated by the numeral 43 and representing a third cigar. Third cigar 43 is comprised of tobacco filler 33, inner layer 30 and middle layer 29. In FIG. 6, third cigar 43 is shown being placed within package 11 interior 14 so that it can be resealed at resealable closure 12. Arrow 42 thus illustrates the completion of second cigar 40 and its combustion for smoking while arrow 44 illustrates the placement of third cigar 43 in package 11 where it is preserved when resealable closure 12 is closed.

Figure 7:
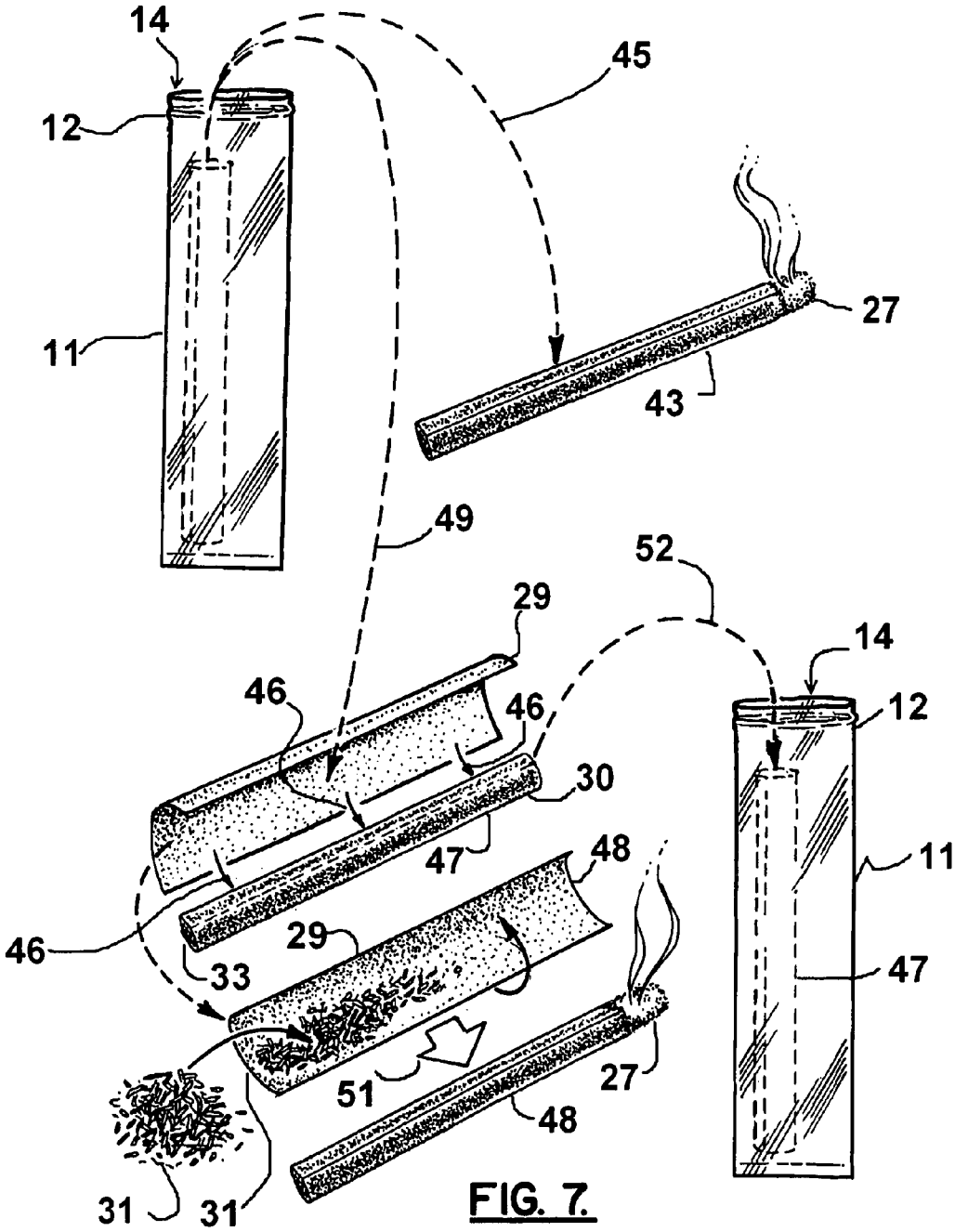
FIG. 7 is a perspective view illustrating various method steps where the consumer has a choice of now removing the tobacco product of FIG. 6 from the original packaging, and having it lit for smoking; or removing the middle sheet or layer from such tobacco product and using this middle sheet or layer to make a custom cigar and lit for smoking, along with returning the remaining inner cigar or cigarillo core into the original packaging.

At a later date, a consumer can remove third cigar 43 from package 11. A consumer has two options when removing third cigar 43 from package 11 as shown in FIG. 7. The first option is to smoke the third cigar 43 as illustrated by arrow 45. A second option is to disassemble the middle layer 29 from inner layer 30 (see arrow 49). This removal of layer 29 from the combination of layer 30 and tobacco filler 33 as illustrated by arrows 46, produces a fourth cigar 47. That fourth cigar 47 can be placed in container 11 and sealed at closure 12 (see arrow 52). A smoker can then take the intermediate layer 29 and form a fifth cigar 48 by rolling a user's custom tobacco material 31 within the layer 29 as illustrated by arrow 51 in FIG. 7.

Figure 8:
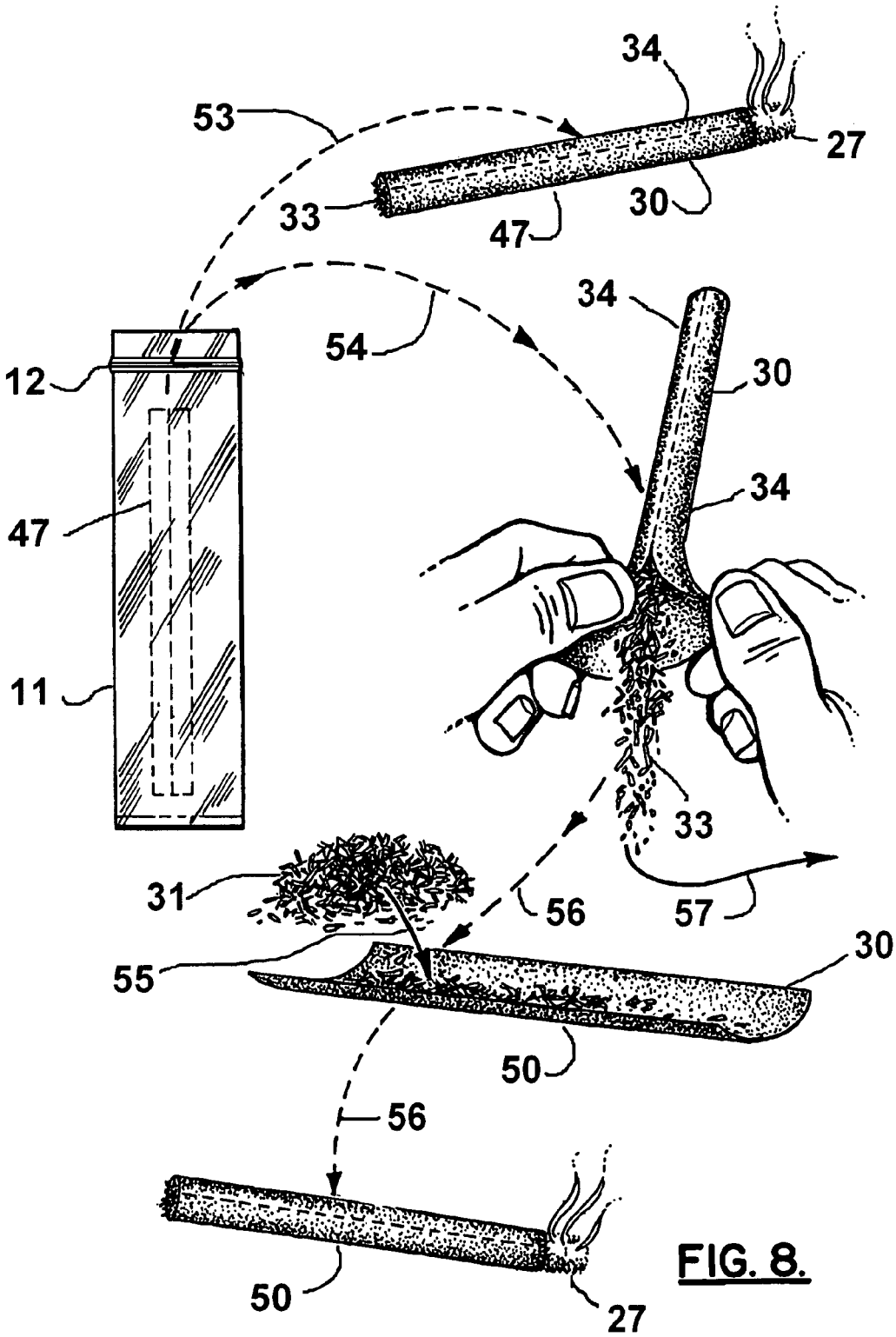
FIG. 8 is a perspective view illustrating various method steps where the consumer has a choice of now removing the inner cigar or cigarillo core and having it lit for smoking, or such core is opened along the perforation line to remove the tobacco filler material and allow the user to select custom tobacco filler for forming a custom cigar, and ultimately the custom cigar is lit for smoking.

At a later date, a smoker can remove the fourth cigar 47 from container or package 11 as illustrated by arrows 53 and 54 in FIG. 8. Arrow 53 illustrates that fourth cigar 47 can be smoked. Arrow 54 illustrates that fourth cigar 47 can be disassembled by tearing layer 30 at perforation or serration 34. By tearing fourth cigar 47 at perforation or serration 34, the contents 33 are discarded (arrow 57) and replaced with a user's custom tobacco 31 as illustrated by arrows 55, 56. By rolling sheet or layer 30 about a user's custom tobacco 31, the user or consumer can produce a sixth cigar 50 that can smoked as illustrated in FIG. 8.

Figure 9:
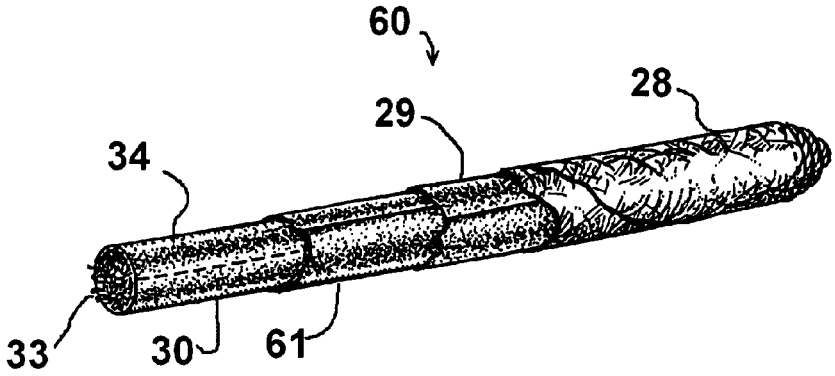
FIG. 9 is a partially cutaway perspective view of an alternative tobacco product similar to the construction shown in FIG. 3 but with two middle sheets or layers including the outer sheet of natural leaf, two middle sheets of homogenized tobacco paper, and inner cigar or cigarillo core where the core has a longitudinal set of perforations on its wall.

FIG. 9 illustrates an additional embodiment of the apparatus of the present invention, designated generally by the numeral 60. Cigar article 60 is similar to the cigar article 10 of FIGS. 1-8, but adds an additional middle or intermediate sheet or layer 29, that additional middle or intermediate sheet or layer being designated by the numeral 61. By providing two intermediate sheets or layers 29, 61 for the article 60, another additional two cigars are provided including an extra cigar that can be made from sheet or layer 61 and a cigar that can be smoked which is comprised of the sheets or layers 29, 30, 61 and filler 33.

FIGS. 10-14 illustrate that other constructions for caps 18, 23 can be provided. In FIGS. 10 and 11, the cigar 10 can be fitted with end caps 58, 59. Each of the end caps 58, 59 can be constructed of a cylindrical side wall 62 and a circular end wall 63. The entire end cap 58 or 59 can be of smokable, combustible material such as of tobacco leaf material, cellulose, paper or any other combustible, smokable material. FIGS. 12 and 13 illustrate that end caps 64, 65 can be of a plastic material such as polypropylene. End caps 64, 65 include a cylindrical wall 66, circular end wall 67, and anchor or spike 68 or other projection that is spaced inwardly of the wall 66 and that protrudes from wall 67 as shown in FIG. 13.

FIG. 14 shows yet another construction for end caps which are designated as end caps 69, 70. The end caps 69, 70 are in the form of combustible, smokable discs that can be attached to cigar 15 as illustrated by arrows 71, 72. Glue such as tobacco glue could be used to fasten or attach discs 69, 70 to first cigar 15. As with embodiment of FIGS. 1-8, serrations 21, 22 are provided at end portion 16, 17 respectively as shown in FIG. 14. In order to remove an end cap 69 or 70, a user twists the end cap 69 or 70 in order to break the serration 21 or 22, thus effecting a removal of the end cap 69 or 70 from first cigar 15. The end caps of FIGS. 10-14 could be secured to the first cigar 15 using a frictional fit, glue, tobacco glue or an adhesive.

The following is a list of reference numerals which are used in this application.

LIST OF REFERENCE NUMERALS

| Reference Number | Description |
|---|---|
| 10 | cigar article or tobacco product |
| 11 | package |
| 12 | resealable closure |
| 13 | tear notch |
| 14 | package interior |
| 15 | first cigar |
| 16 | end portion |
| 17 | end portion |
| 18 | end cap |
| 19 | arrow |
| 20 | arrow |
| 21 | perforation or serration |
| 22 | perforation or serration |
| 23 | end cap |
| 24 | arrow |
| 25 | arrow |
| 26 | arrow |
| 27 | burning part |
| 28 | outer sheet or layer |
| 29 | intermediate/middle sheet or layer |
| 30 | inner sheet or layer |
| 31 | user's custom tobacco |
| 32 | arrow |
| 33 | tobacco filler |
| 34 | perforation/perforation line/serrated line/serration |
| 35 | edge |
| 36 | edge |
| 37 | diagonal edge |
| 38 | diagonal edge |
| 39 | arrow/unrolling |
| 40 | second cigar |

-continued

LIST OF REFERENCE NUMERALS

| Reference Number | Description |
|---|---|
| 41 | arrow |
| 42 | arrow |
| 43 | third cigar |
| 44 | arrow |
| 45 | arrow |
| 46 | arrow |
| 47 | fourth cigar |
| 48 | fifth cigar |
| 49 | arrow |
| 50 | sixth cigar |
| 51 | arrow |
| 52 | arrow |
| 53 | arrow |
| 54 | arrow |
| 55 | arrow |
| 56 | arrow |
| 57 | arrow |
| 58 | end cap |
| 59 | end cap |
| 60 | cigar article |
| 61 | additional intermediate/middle sheet or layer |
| 62 | cylindrical side wall |
| 63 | circular end wall |
| 64 | end cap |
| 65 | end cap |
| 66 | cylindrical side wall |
| 67 | circular end wall |
| 68 | projection/anchor/spike |
| 69 | end cap |
| 70 | end cap |
| 71 | arrow |
| 72 | arrow |
| 100 | inner cigar or cigarillo core |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of constructing a cigar, comprising the steps of:

a) providing a plurality of layers of smokable material that include inner, middle and outer layers, said inner and middle layers being inner and outer concentric tubes, each tube having tube ends;

b) serrating at least one of the tubes, enabling the tube to be opened by rupturing the tube at the serration;

c) filling the inner tube with tobacco fill material;

d) wrapping the outer layer about the concentric tubes;

e) capping both ends of the assembly of tubes and outer layers with an end cap that prevents discharge of the tobacco fill material from a tube end, wherein the end cap is in the form of twisted tobacco material that is part of the outer layer;

f) providing a manually rupturable connection between at least one end cap and the assembly of step "e"; and g) wherein the cigar constructed in steps "a" through "f" is packaged for sale in packaging.

2. The method of claim 1 wherein in step "f" the rupturable connection includes a serration of a layer next to the end cap.

3. The method of claim 2 wherein the outer layer includes a serration next to an end cap.

4. The method of claim 1 wherein the cigar can be disassembled to separate the outer layer while the inner layer, middle layer and tobacco filler define a second cigar.

5. The method of claim 4 further comprising packaging the second cigar in a package.

6. The method of claim 5 further comprising removing the cigar from the package and forming one or more new cigars by disassembling the cigar and forming one or more new cigars using one or more of the layers for each new cigar and a user's custom tobacco as a filler material.

7. The method of claim 5 further comprising removing the cigar from the package and forming multiple new cigars by disassembling the cigar and forming multiple new cigars using multiple layers for each new cigar and a user's custom tobacco as a filler material.

8. The method of claim 1 wherein in step "f" one of the manually rupturable connections is a serration on the outer layer.

9. The method of claim 1 wherein in step "f" each of the manually rupturable connections is a serration on the outer layer.

10. A method of constructing a cigar, comprising the steps of:

a) providing a plurality of layers of smokable material that include inner, middle and outer layers, said inner and middle layers being inner and outer concentric tubes, each tube having tube ends;

b) filling the inner tube with tobacco fill material;

c) wrapping the outer layer about the inner and outer concentric tubes;

d) capping at least one end of the assembly of tubes and outer layers with a cap that prevents discharge of the tobacco filler material from a tube end, wherein the end cap is in the form of twisted tobacco material that is part of the outer layer;

e) providing a manually rupturable connection between the cap and the assembly of step "d"; and f) wherein the cigar constructed in steps "a" through "e" is packaged for sale in packaging.

11. The method of claim 10 wherein in step "d" each end of the assembly is capped with a cap.

12. The method of claim 10 wherein in step "e" the rupturable connection includes a serration of a layer next to the cap.

13. The method of claim 12 wherein the outer layer includes a serration next to a cap.

14. The method of claim 11 wherein in step "e" the rupturable connection includes a serration of a layer next to each cap.

* * * * *